United States Patent [19]

Hallstedt

[11] Patent Number: 4,790,200

[45] Date of Patent: Dec. 13, 1988

[54] PROGRESSIVE CONTROL

[75] Inventor: Lennart Hallstedt, Lyckeby, Sweden

[73] Assignee: Dynapac Light Equipment AB, Ljungby, Sweden

[21] Appl. No.: 465,029

[22] Filed: Feb. 8, 1983

[30] Foreign Application Priority Data

Feb. 9, 1982 [SE] Sweden ..... 8200733

[51] Int. Cl.[4] ..... G05G 1/00; G05G 1/04

[52] U.S. Cl. ..... 74/517; 74/470; 74/491; 267/150

[58] Field of Search ..... 74/517, 491, 470, 501 R, 74/89, 99 R, 473 R; 267/150, 174

[56] References Cited

U.S. PATENT DOCUMENTS

| | | | |
|---|---|---|---|
| 2,439,356 | 4/1948 | Arens | 74/517 |
| 3,837,417 | 9/1974 | Little | 74/491 |
| 3,847,034 | 11/1974 | Hemens | 74/491 |
| 4,008,626 | 2/1977 | Schulte et al. | 74/491 |
| 4,112,783 | 9/1978 | Beier | 74/517 |
| 4,217,789 | 8/1980 | Larson | 74/470 |
| 4,221,277 | 9/1980 | Mastropieri | 74/470 |
| 4,236,422 | 12/1980 | Cochran et al. | 74/517 |
| 4,238,975 | 12/1980 | Jones | 74/470 |

FOREIGN PATENT DOCUMENTS

| | | | |
|---|---|---|---|
| 1082965 | 6/1960 | Fed. Rep. of Germany | 267/150 |
| 1213693 | 3/1966 | Fed. Rep. of Germany | 267/150 |
| 1517623 | 7/1978 | United Kingdom . | |
| 2048438 | 12/1980 | United Kingdom . | |

*Primary Examiner*—Gary L. Smith
*Assistant Examiner*—Vinh Luong
*Attorney, Agent, or Firm*—Brumbaugh, Graves, Donohue & Raymond

[57] ABSTRACT

A manually actuated control device comprises an operating component 1 and an adjusting component 4 which are connected to each other via spring elements 3 and 5 in order to achieve a non-linear output motion of the adjusting component 4 responsive to movement of the operating component 1.

3 Claims, 1 Drawing Sheet

Fig. 1.
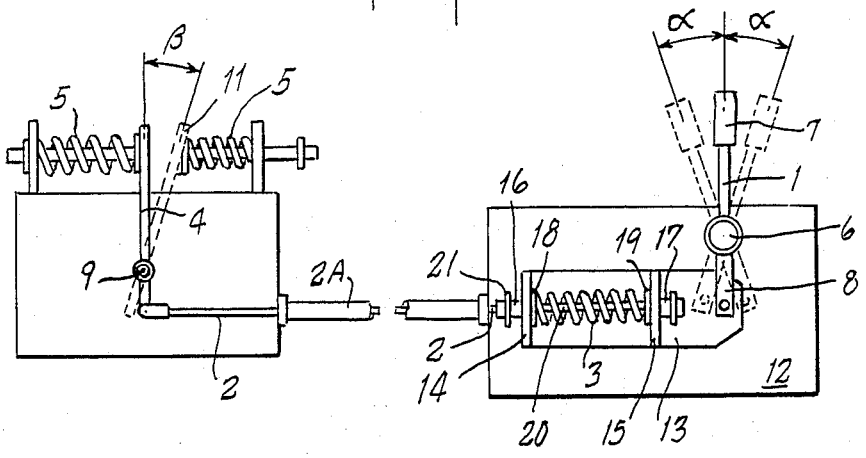
Fig. 1A.
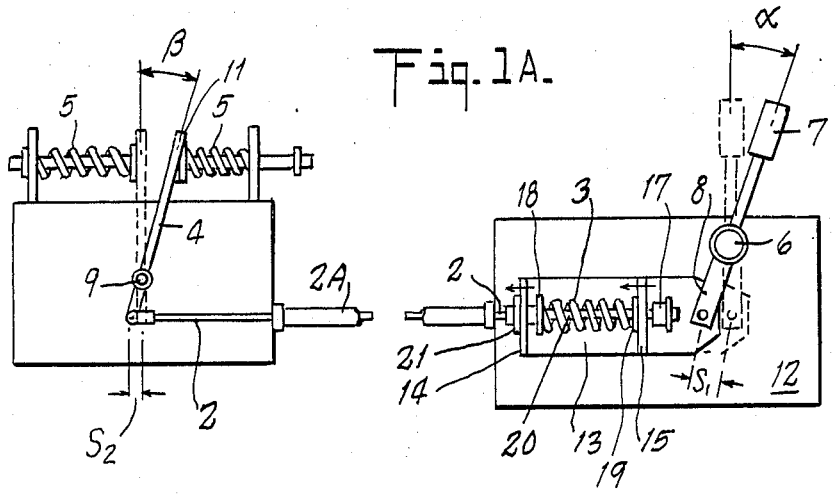
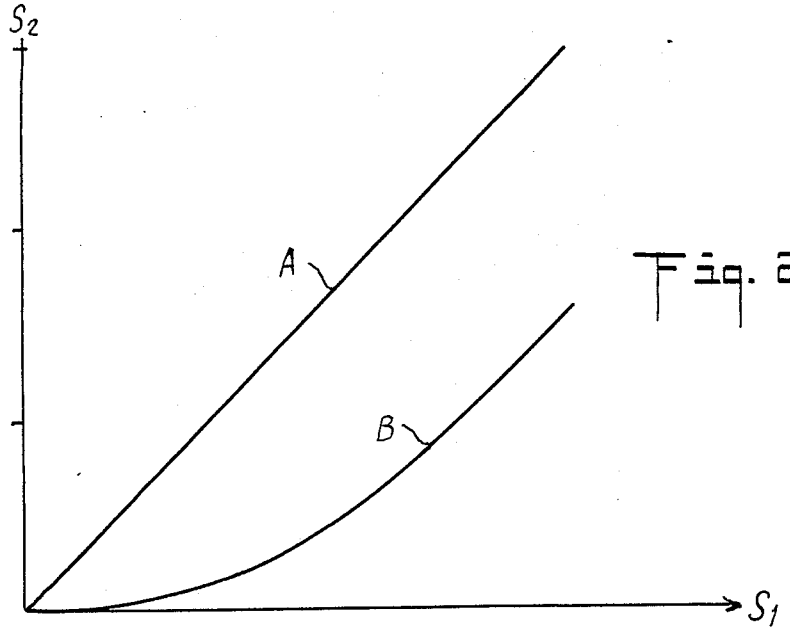
Fig. 2.

PROGRESSIVE CONTROL

BACKGROUND OF THE INVENTION

The present invention relates to a manually actuated control device for mechanically regulating the speed of hydraulic pumps on hydraulically driven vehicles.

On hydraulically driven vehicles, such as various types of rollers, progressive adjustment of the drive device for forward and reverse motion is necessary. Other applications for progressive control are flow restrictor valves, throttle control on combustion engines, various control connections which may be mechanical, hydraulic or pneumatic and designed for vehicles, construction machines, boats or aircraft, etc. where control should be progressive.

A hydraulic motor usually operates at fixed output power. The supply of hydraulic power to the motor must therefore be controlled so that starting and braking of the motor can be achieved smoothly. It is previously known that with the aid of a slot cut into an operating disc it is possible to produce a movement in, for example, an operating cable interacting with the slot which is a non-linear function of the movement of the pertinent control lever or pedal. This method of achieving non-linear movement in an operating cable is comparatively complicated, however.

SUMMARY OF THE INVENTION

The present invention is a manually actuated control device in which the output is a non-linear function of the movement applied to the input, the control lever or pedal. In a typical embodiment, the input lever is connected to a cable which in turn is connected to operate a hydraulic pump. The non-linear or progressive movement is achieved by the use of a number of springs interacting with the control components. The present invention is particularly simple in construction and furthermore permits the use of an automatic return device to bring the operating cable back to a starting position.

More particularly, in a preferred embodiment according to the invention a manually actuated control apparatus includes an operating component and an adjustment component, the latter adapted to operate a hydraulic motor or the like. Connecting means are provided between the operating component and the adjusting component for actuating the adjusting component in response to actuation of the operating component, e.g., by moving an input lever. The connecting means includes a first spring arranged therein such that there is no rigid connection between the input lever and the adjusting component. A second spring is coupled to the adjusting component for opposing movement thereof, and the spring constants of the first and second springs are different to provide a non-linear relationship between the movement of the operating component and the movement of the adjusting component.

For a better understanding of the invention, reference is made to the following detailed description of preferred embodiments, taken in conjunction with the drawings accompanying the application.

BRIEF DESCRIPTION OF THE DRAWINGS

FIG. 1 is a schematic side view of a manually actuated control apparatus in accordance with the invention;

FIG. 1A is a schematic view of the control apparatus of FIG. 1, shown in an actuated position; and FIG. 2 is a diagramatic illustration of the relationship between the movement of the input component and the movement of the output component of the control apparatus.

DETAILED DESCRIPTION OF PREFERRED EMBODIMENTS

FIG. 1 shows, in solid lines, a manually actuated control apparatus in the neutral position. In the FIG. 1 illustrative embodiment, an operating component, e.g. lever 1, is pivotally mounted at 6 to a control box 12, e.g. the instrument panel of a hydraulic driven vehicle such as a vibratory roller (not shown). The lever 1 is connected to a slide plate 13, which in turn is coupled to an operating cable 2 through a helical spring 3. The opposite end of the cable 2 is connected to an adjusting component 4, for example of a hydraulic pump, which interacts with a double-acting spring assembly 5 whose function it is to return the adjusting component 4 to the neutral, starting position, such position corresponding to that at which the pump is at rest. The spring assembly 5 also offers resistance to spring 3 in the control box, in the manner described below.

Adjusting component 4 is pivotally mounted at 9, such that when cable 2 imparts translational movement to the end 10 of the operating component 4, movement of the component 4 away from the neutral position is opposed by one of the springs 5, which engage end 11 of the component 4.

The spring 3 may be interposed between lever 1 and cable 2 in any suitable manner. In the embodiment shown in FIG. 1, the slide plate 13 has a pair of spaced actuation brackets 14, 15. The end portion of the cable 2 is fixed in a sleeve 20, on which are a pair of end blocks 16, 17. The blocks 16, 17 are slideable in and supported by the actuation brackets 14, 15.

The spring 3 is held between a pair of spring plates 18, 19. Each of the plates 18, 19 is movable toward the center of the spring 3, so as to compress the spring 3. However, the end blocks 16 and 17 prevent any outward movement of the plates, 18 and 19, respectively, from the position shown in FIG. 1.

As illustrated in FIG. 1A, actuation of the handle 7 toward the right, away from the neutral position, displaces the slide plate 13, and thereby the actuation brackets 14, 15, toward the left in FIG. 1A. Actuation bracket 14 moves to the left, as shown by the arrow, freely away from the spring plate 18, sliding along the end block 16. Movement of the spring plate 18, however, is prevented by the end block 16. At the same time, actuation bracket 15 displaces the other spring plate 15 toward the left, as shown in FIG. 1A, so as to compress the spring 3.

As shown, the operating cable 2 is housed in a sheath 2A between the control box 12 and the housing of the operating component, so as to be able to transmit force therebetween.

In the position shown in FIG. 1A, the compressed spring 3 imparts a force on the spring plate 18, which is in turn transmitted to the end block 16 in the manner shown. Accordingly, the spring 3 urges the end block 16, and thereby the cable 2 which is attached to end block 16, toward the left.

The force of the spring, imparted through cable 2 to the operating component 4, is in turn opposed by the force of one of the springs 5, depending upon the direction of movement of the operating handle 7.

In the embodiment shown, when handle 7 is moved away from the center position, the actuating plate 17 begins to impart force on spring 3. Such force continues to increase, as handle 7 is moved toward the right in FIG. 1A, until such time as actuating plate 14 engages a stop plate 21 on the end block 16, which position has been reached in FIG. 1A. Thereafter, upon further actuation of the lever 7, a direct mechanical force is transmitted from the lever, through the actuating plate 14, to the end block 16 and thereby the cable 2. If desired, however, the stop plate 21 may be eliminated, or the length of the end box 16 may be such that the lever 7 may be moved back and forth through its operating limit without imparting any direct force to the cable 2, i.e. so as not to override spring 3.

Progressive action is obtained by transmitting only part of the movement of the operating lever 1, via cable 2, to the adjusting component 4 of the pump during a certain portion of movement of the control or throughout all of its movement. The remainder of the lever movement is absorbed by the spring element 3, as lost motion. Preferably, the movement of operating lever 1 is always greater than the movement of adjusting component 4 by providing spring 3 with a flatter characteristic than the total resistance it has to overcome.

In FIG. 2, movement of the input lever is compared with that of the output lever. A device in which the input lever is mechanically attached to the output lever is represented by straight line A. In comparison, a typical arrangement of the invention, in which the distance of output movement $S_2$ of lever 4 is plotted against the displacement $S_1$ of the input lever 1, is depicted in curve B. As the input lever 1 is moved from center, it effects only a relatively small displacement $S_2$ of the output lever. The output movement $S_2$ becomes progressively larger as the input lever 1 is pulled toward the extremes of its movement. By modifying the relative spring constants between the spring 3 and springs 5, the characteristic shape of the curve B can be modified to suit a particular application for achieving the desired control of the hydraulic motor.

On movement of the operating handle 7 through an angle $\alpha$, the end 8 of the lever 1 moves the distance $S_1$. Owing to the effect of spring 3, the movement transmitted via cable 2 to the end 10 of the adjusting component 4 is only the distance $S_2$, and the end 11 then moves against the force of spring assembly 5 through an angle $\beta$.

As discussed above, the straight line A shows the relationship between $S_1$ and $S_2$ in the case of equal leverage and with direct transmission of the movement of the operating component to the adjustment component. By transmitting the regulating movement to the adjusting component via spring elements, a non-linear movement is obtained in the adjusting component as represented by curve B.

In the embodiment described above, one of the two actuating brackets 14, 15, imparts a compressive force to the spring 3, depending upon which way the handle 7 is moved. In a modified form of the FIG. 1 embodiment, one end of spring 3 is fixed to the lever 1, and the other end of the spring 3 is attached to the cable 2. The operating lever 1 may be connected to the adjusting bracket 15 mechanically. Bracket 15 is attached to the one end of the spring 3. Bracket 14 is eliminated and the spring plate 18, at the other end of the spring 3, is fixed to the end block 16. The sleeve 20 is supported in the adjusting plate 15, but is freely slideable therein. As will be apparent, movement of the lever 1 imparts either a compressive or expansive force to the spring 3, which transmits such force to the cable 2.

The foregoing represents a description of preferred embodiments of the invention. Variations and modifications of the devices discussed above will be apparent to persons skilled in the art, without departing from the principles of the invention. In particular, other suitable means of coupling the input lever 1 to the operating cable 2, through the interposition of a spring 3, may be employed. All such variations and modifications are intended to be within the scope of the invention as defined in the following claims.

I claim:

1. A manually actuated control apparatus comprising an operating component and an adjusting component; connecting means between the operating component and the adjusting component for actuating the adjusting component in response to actuation of the operating component, the connecting means including a first spring means interposed therein for absorbing, as last motion, a portion of the movement of said operating component; and a second spring means coupled to the adjusting component for opposing movement thereof, to provide a non-linear relationship between the movement of the operating component and the movement of the adjusting component.

2. A device as in claim 1, wherein the connecting means includes an operating cable, wherein the cable is connected to the adjusting component, and wherein the operating component is connected by the first spring means to said operating cable.

3. A device as defined in claim 2, wherein the second spring means comprises a double-acting spring assembly for urging the adjusting the component to a neutral position.

* * * * *

UNITED STATES PATENT AND TRADEMARK OFFICE

CERTIFICATE OF CORRECTION

PATENT NO. : 4,790,200

DATED : December 13, 1988

INVENTOR(S) : Lennart Hallstedt

It is certified that error appears in the above-identified patent and that said Letters Patent is hereby corrected as shown below:

Col. 4, line 38, "last" should read --lost--

Signed and Sealed this

Sixth Day of June, 1989

*Attest:*

*Attesting Officer*

DONALD J. QUIGG

*Commissioner of Patents and Trademarks*